US006705271B2

(12) United States Patent
Liu

(10) Patent No.: US 6,705,271 B2
(45) Date of Patent: Mar. 16, 2004

(54) FOUR-STROKE CYCLE INTERNAL COMBUSTION ENGINE

(75) Inventor: Yumin Liu, Fussa (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 10/232,310

(22) Filed: Sep. 3, 2002

(65) Prior Publication Data

US 2003/0047157 A1 Mar. 13, 2003

(30) Foreign Application Priority Data

Sep. 7, 2001 (JP) ..... 2001-271740

(51) Int. Cl.[7] ..... F01M 1/00
(52) U.S. Cl. ..... 123/196 R
(58) Field of Search ..... 123/196 R, 90.33, 123/196 M, 311

(56) References Cited

U.S. PATENT DOCUMENTS 6,202,613 B1 3/2001 Nagai
6,422,194 B2 * 7/2002 Ito et al. ..... 123/196 R

* cited by examiner

*Primary Examiner*—Tony M. Argenbright
*Assistant Examiner*—Katrina Harris
(74) *Attorney, Agent, or Firm*—Nixon Peabody LLP; Donald R. Studebaker

(57) ABSTRACT

The present invention relates to a four-stroke cycle internal combustion engine in which lubrication oil is atomized to generate oil mist so as to lubricate an internal mechanism of the engine with the oil mist. The four-stroke cycle internal combustion engine includes an oil-mist breather in fluid communication with a fuel tank of the engine. Any oil mist remaining after the lubrication of the internal mechanism is discharged into the fuel tank 14 through the oil-mist breather 22. Since no oil mist remains in the oil-mist breather the air filter of the engine is not contained by the oil mist.

10 Claims, 2 Drawing Sheets

FOUR-STROKE CYCLE INTERNAL COMBUSTION ENGINE

FIELD OF THE INVENTION

The present invention relates to a four-stroke cycle internal combustion engine, in which oil mist is generated in the vicinity of a crank chamber and the generated oil mist is fed from the crank chamber to a valve chamber through an oil-mist passage so as to lubricate internal mechanisms in the crank chamber and the valve chamber, and more particularly to a four-stroke cycle internal combustion engine having an oil-mist breather.

BACKGROUND OF THE INVENTION

It has been known in a conventional four-stroke cycle internal combustion engine to generate oil mist in the vicinity of a crank chamber. The generated oil mist is fed from the crank chamber to a valve chamber through an oil-mist passage so as to lubricate internal mechanisms in the crank and the valve chambers. In such a four-stroke cycle internal combustion engine, an oil reservoir chamber is typically provided below the crank chamber to accommodate lubrication oil therein. The lubrication oil reserved in the oil reservoir chamber is atomized or formed into an oil mist, for example, by splattering the lubrication oil by an oil dipper provided at the lower end of a connecting rod or by agitating the lubrication oil with a coil spring. The oil-mist passage is formed in a cylinder block of the engine to provide fluid communication between the crank chamber and the valve chamber, so that the oil mist is fed from the crank chamber to the valve chamber through the oil-mist passage by a force of a positive pressure in the crank chamber during a downward movement of a piston of the engine. The oil mist fed into the valve chamber lubricates a valve mechanism in the valve chamber, and the remaining oil mist is discharged from an oil-mist breather.

In the conventional four-stroke cycle internal combustion engine, the oil-mist breather is generally disposed in the vicinity of an inlet of an air intake system, and an air filter is also disposed in the vicinity of the inlet of the air intake system. Thus, the oil mist discharged from the oil-mist breather is sucked through the air filter together with outside air, and part of the oil mist is trapped by the air filter. The trapped oil mist or lubrication oil undesirably accelerates contamination of the air filter, resulting in reduced intake air flow.

SUMMARY OF THE INVENTION

It is therefore an object of the present invention to provide a four-stroke cycle internal combustion engine having an oil-mist breather free from the defect causing contamination of the air filter.

In order to achieve the above object, the present invention provides a four-stroke cycle internal combustion engine in which lubrication oil is atomized to generate oil mist so as to lubricate an internal mechanism of the engine with the oil mist. The four-stroke cycle internal combustion engine includes an oil-mist breather in fluid communication with a fuel tank of the engine. The oil mist remaining after lubrication of the internal mechanism is discharged into the fuel tank through the oil-mist breather.

In the four-stroke cycle internal combustion engine of the present invention, an air which contains oil mist remaining after the lubrication of the internal mechanism is discharged into the fuel tank through the oil-mist breather, and the air which contains the oil-mist discharged from the oil-mist breather acts to compensate all or a part of the reduced volume in the fuel tank caused by pumping fuel out of the fuel tank. If the air containing the oil-mist from the oil-mist breather is insufficient to compensate the reduced volume in the fuel tank, a fuel-tank breather may be provided to bring additional outside air into the fuel tank therethrough so as to supplement the insufficient quantity. The discharged lubricating oil into the fuel tank is mixed with the fuel in the fuel tank, and then burnt in a combustion chamber of the engine together with the fuel. Even if some lubricating oil is contained in the fuel, the four-stroke cycle internal combustion engine does not receive any adverse effect in its performance.

As above, the air containing the oil mist remaining after lubrication of the internal mechanism is discharged into the fuel tank. Thus, the four-stroke cycle internal combustion engine of the present invention eliminates the conventional problem that the air filter provided at the inlet of the intake system is contaminated by the lubricating oil thereby preventing the air filter from reducing intake air flow. Thus, surroundings of the engine is free from contamination from the lubricating oil.

Further, the present invention provides a four-stroke cycle internal combustion engine in which oil mist is generated in the vicinity of a crank chamber and the generated oil mist is fed from the crank chamber to a valve chamber through an oil-mist passage so as to lubricate the inside of the crank camber and the valve chamber. The four-stroke cycle internal combustion engine includes an oil-mist breather including a breather passage for providing fluid communication between the valve chamber and the fuel tank. In this case, the remaining oil mist in the valve chamber is discharged into the fuel tank through the oil-mist breather.

In this four-stroke cycle internal combustion engine of the present invention, an air containing the oil mist remaining after the lubrication of respective internal mechanisms of the crank chamber and the valve chamber is discharged into the fuel tank through the oil-mist breather. The discharged lubricating oil is mixed with a fuel in the fuel tank, and then burnt in a combustion chamber of the engine together with the fuel.

Thus, the four-stroke cycle internal combustion engine of the present invention eliminates the conventional defect in that the air filter provided at the inlet of the intake system is contaminated by the lubricating oil thereby preventing the air filter from reducing intake air flow. Surroundings of the engine are free from contamination due to the lubricating oil.

In one specific embodiment of the present invention, the oil-mist breather may include a check valve disposed in the breather passage and an orifice disposed in the breather passage on the upstream side of the check valve. The check valve is operable to close the breather passage when a fuel in the fuel tank flows into the breather passage and when a piston of the engine is moving upward.

In the above embodiment, the orifice and the check valve may be disposed in the vicinity of the fuel tank along the longitudinal direction of the breather passage.

Further, in the above embodiment, the check valve may be disposed closer to the fuel tank than the orifice, and the check valve may include a valve member for closing an outlet of the orifice on the side of the fuel tank.

Other features and advantages of the present invention will be apparent from the accompanying drawings and from the detailed description.

DESCRIPTION OF THE PREFERRED EMBODIMENT

Figure 1:
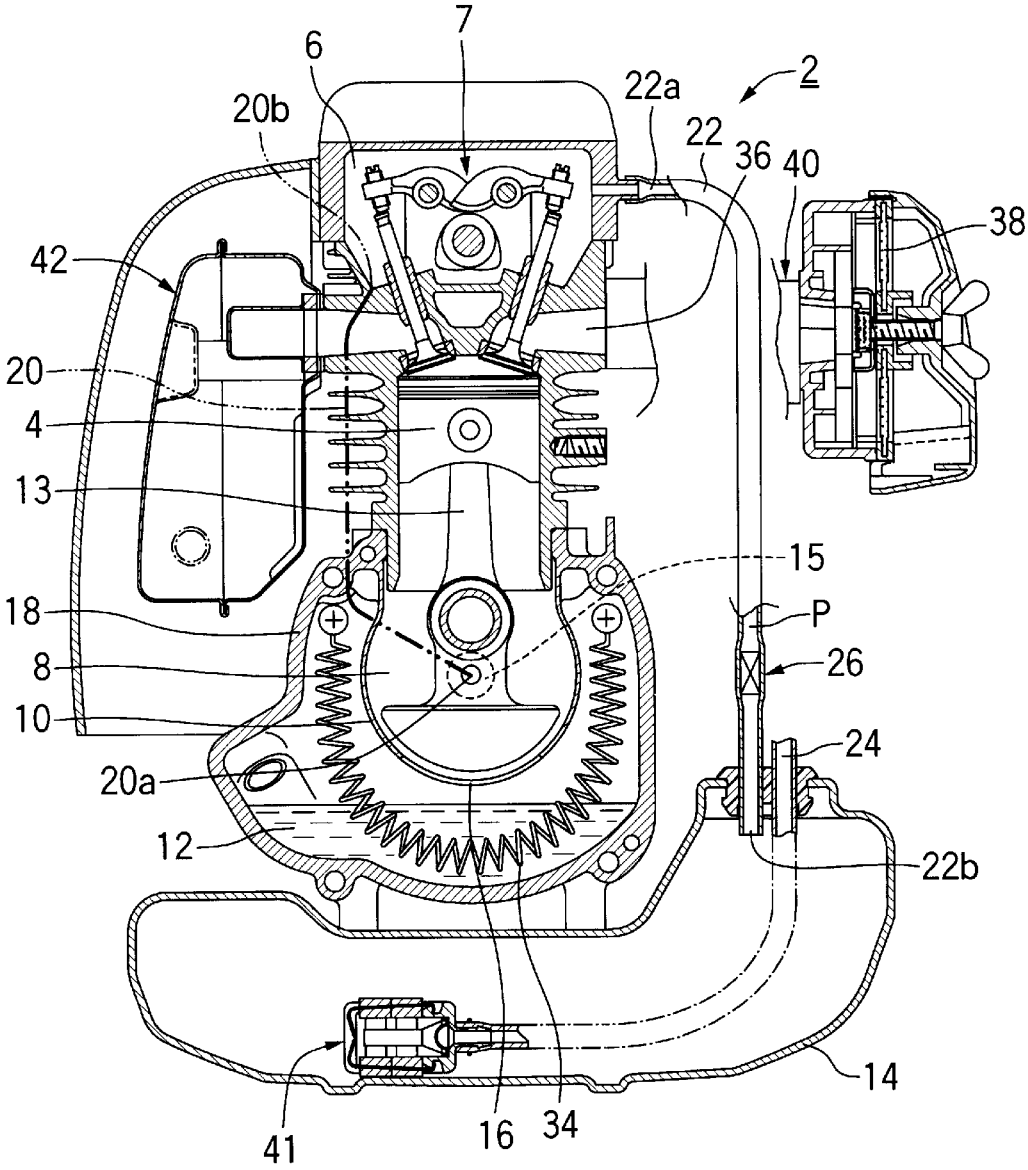
FIG. 1 is a vertical cross-sectional view of a four-stroke cycle internal combustion engine according to one embodiment of the present invention.

With reference to the drawings, a four-stroke cycle internal combustion engine 2 is typically used as a power source for a grass trimmer, a portable chemical sprayer or the like, and can be handled not only in an upright posture as shown in FIG. 1 but also in an inclined or inversed posture during operation.

The four-stroke cycle internal combustion engine 2 according to the present invention is an OHC type four-stroke cycle internal combustion engine comprising a piston 4 reciprocating vertically or moving upward and downward, a valve chamber 6 disposed above the piston 4, a crank chamber 8 disposed below the piston 4, an oil reservoir chamber 12 disposed below the crank chamber with interposing a partition wall 10 therebetween to reserve lubrication oil therein, and a fuel tank 14 disposed below the oil reservoir chamber 12. The crank chamber 8 accommodates therein an internal mechanism such as the piston 4, a connecting rod 13, and a crankshaft 15. The valve chamber 6 also accommodates an internal mechanism such as a cam-type valve mechanism 7 therein.

The partition wall 10 is formed with a slit 16 for providing fluid communication between the crank chamber 8 and the oil reservoir chamber 12. A cylinder block 18 of the engine 2 is formed with an oil-mist passage 20 for providing fluid communication between the crank chamber 8 and the valve chamber 6. The oil-mist passage 20 has an upstream end 20*a* opened to the crank chamber 8 and a downstream end 20*b* opened to the valve chamber 6. The four-stroke cycle internal combustion engine 2 also comprises an oil-mist breather 22 including a breather passage P for providing fluid communication between the valve chamber 6 and the fuel tank 14. The oil-mist breather 22 is a generally tubular member which defines therein a substantial part of the breather passage P and has an upstream end 22*a* in fluid communication with the valve chamber 6 and a downstream end 22*b* inserted into the fuel tank 14. The fuel tank 14 is formed to have an independent inner space for reserving fuel such as gasoline therein. A fuel pipe 24 is also inserted into the fuel tank. The gasoline in the fuel tank 14 is supplied to a carburetor 40 through a strainer 41 immersed in the gasoline and the fuel pipe 24.

Figure 2:
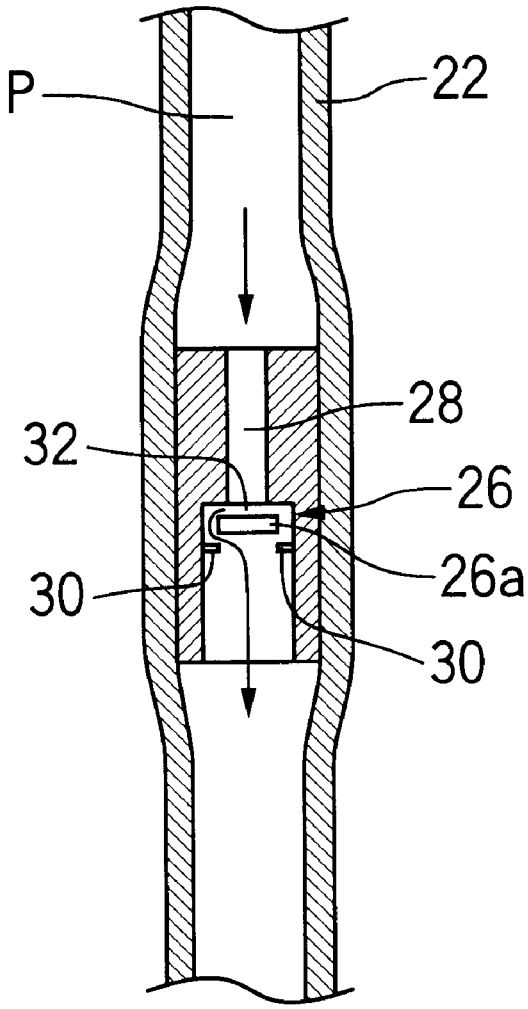
FIG. 2 is a vertical cross-sectional view of a check valve and an orifice provided in an oil-mist breather in the four-stroke cycle internal combustion engine according to the embodiment of FIG. 1.

As can be seen from FIG. 2, the oil-mist breather 22 includes a check valve 26 disposed in the breather passage P, and an orifice 28 disposed in the breather passage P on the upstream side of the check valve 26. The orifice 28 has an inner diameter less than that of the breather passage P. In this embodiment, the check valve 26 and the orifice 28 are disposed in the vicinity of the fuel tank 14 along the longitudinal direction of the oil-mist breather 22, i.e., the breather passage P.

The check valve 26 includes a valve member 26*a* for closing the downstream outlet of the orifice 28 located at the fuel tank side. The valve member 26*a* is formed as a disk-shaped member having a specific gravity less than the fuel. The check valve also includes a stopper 30 disposed downstream of the valve member 26*a* to define a check-valve chamber 32 for accommodating the valve member 26*a* therein while controlling the movable distance in the upward and the downward of valve member 26*a* within a given range. The valve member 26*a* is originally intended to prevent the fuel in the fuel tank 14 from flowing into the valve chamber 6 through the oil-mist breather 22 or the breather passage P, for example, when the four-stroke cycle internal combustion engine 2 is used in the inclined or inversed posture. The valve member 26*a* is moved along the longitudinal direction of the breather passage P of the oil-mist breather 22 by force of positive and negative pressures in the crank chamber 8 resulting from the vertical reciprocating movement of the piston 4, so as to open and close the downstream outlet side of the orifice 28.

Referring again to FIG. 1, the oil reservoir chamber 12 is formed in a U-shape surrounding the right, left and bottom sides of the crank chamber 8. The oil reservoir chamber 12 accommodates therein a coil spring 34 serving as a device for generating oil mist. The coil spring 34 is positioned to form a U-shape along the U-shaped oil reservoir chamber 12. The right and left ends of the coil spring 34 are attached to corresponding upper right and upper left ends of the oil reservoir chamber 12. The lower portion of the U-shaped coil spring 34 is immersed in the lubricating oil reserved in the oil reservoir chamber 12. When an operator actuates an operating machine (not shown) provided with the four-stroke cycle engine 2 and the four-stroke cycle internal combustion engine 2 vibrates in operation, the coil spring 34 is vibrated to splatter the lubricating oil so that the lubricating oil is atomized or formed into an oil mist.

As shown in FIG. 1, the four-stroke cycle internal combustion engine 2 also includes an air filter 38 disposed upstream of the carburetor 40 connected to an intake port 36.

The four-stroke cycle internal combustion engine 2 according to the present invention operates as follows.

Once the four-stroke cycle internal combustion engine 2 is actuated, the piston 4 moves upward and downward. The lubricating oil in the oil reservoir chamber 12 is splattered by the vibration of the coil spring 34 and is thereby atomized or formed into an oil mist. The generated oil mist flows into the crank chamber 8 through the slit 16 of the partition wall 10 by force of a negative pressure in the crank chamber 8 resulting from the upward movement of the piston 4. This oil mist lubricates the internal mechanism in the crank chamber 8. When the piston 4 moves downward causing a positive pressure in the crank chamber 8, the oil mist is fed to the valve chamber 6 through the oil-mist passage 20 to lubricate the internal mechanism in the valve chamber 6.

The oil mist remaining after the lubrication of the valve chamber is discharged into the fuel tank 14 through the orifice 28 of the oil-mist breather 22 due to the positive pressure resulting from the downward movement of the piston 4. During this operation, the check valve 26 is opened (or the downstream outlet of the orifice is opened). The discharged oil mist is mixed with the fuel in the fuel tank 14, and is then supplied to the carburetor 40 together with the fuel. Air containing the remaining oil mist discharged into the fuel tank 14 acts to compensate the reduced volume in the fuel tank 14 caused by consuming the fuel. If the oil-mist-containing air is insufficient to completely compensate the reduced volume, a fuel-tank breather provided in the fuel tank 14 takes in additional outside air into the fuel tank therethrough.

When the operator uses the operating machine in the inclined or inversed posture, the fuel flows from the fuel tank 14 into the breather passage P and pushes the valve member 26*a* to close the outlet on the downstream side of the orifice 28. This prevents the fuel from flowing into the valve chamber 6.

Respective functions/actions of the orifice 28 and the check valve 26 will be described below.

Check valve 26 is originally intended to prevent the fuel in the fuel tank 14 from flowing into valve chamber 6 though the breather passage. However, the valve member 26*a* of the check valve 26 is also moved to close the downstream outlet of the orifice 28 due to the negative pressure in the crank chamber 8 and the valve chamber 6 resulting from the upward movement of the piston 4. As a result, the negative pressure in the crank chamber 8 is increased as compared to when the check valve 26 is omitted. This causes undesirable resistance during the upward movement of the piston 4.

The orifice 28 is provided to suppress this undesirable resistance. More specifically, the oil-mist-containing air is discharged into the fuel tank 14 due to the positive pressure in the crank chamber 8 and the valve chamber 6 resulting from the downward movement of the piston 4. At the same time, a certain flow resistance is caused because the breather passage P is narrowed down by the orifice, and whereby the oil-mist-containing air is compressed on the upstream side of the orifice 28. Subsequently, the piston 4 moves upward to provide a negative pressure in the crank chamber 8 and the valve chamber 6, and whereby the valve member 26*a* is moved to close the downstream outlet of orifice 28. During this operation, the compressed oil-mist-containing air acts to suppress abrupt increase of the negative pressure in the crank chamber 8. This prevents the resistance during the upward movement of the piston 4 from being undesirably increased.

As above, the oil-mist breather includes the check valve 26 disposed in the breather passage P, and the orifice 28 disposed in the breather passage P upstream of the check valve 26. This prevents the fuel in the fuel tank 14 from flowing into the valve chamber 6 through the breather passage P, and prevents the resistance against the piston 4 caused by the check valve 26 from being undesirably increased. Thus, the four-stroke cycle internal combustion engine can maintain its desired output power.

Further, in the oil-mist breather according to the present embodiment the orifice 28 and the check valve 26 are disposed in the breather passage in the vicinity of the fuel tank 14. This provides increased volume of the oil-mist containing air to be compressed upstream of the orifice 28, and allows the resistance against the piston 4 to be minimized.

Furthermore, in the oil-mist breather, the orifice 28 and the check valve 26 are disposed adjacent to each other, the valve member 26*a* is operable to close the downstream outlet of the orifice 28 by force of the negative pressure in the crank chamber 8. This provides a simplified structure of the check valve 26.

It is to be understood that the present invention is not limited to the above embodiment, and various modifications can be made without departing from the sprit and scope of the present invention defined only by the appended claims. Therefore, it is intended to encompass such modifications within the scope of the present invention.

While the four-stroke cycle internal combustion engine 2 according to the above embodiment includes the orifice 28 and the check valve 26 because the engine 2 is employed in a grass trimmer, a portable chemical sprayer or the like, and used in the inclined or inversed posture, the check valve 26 is not essential when the four-stroke cycle internal combustion engine 2 is used only in the upright posture, for example, in a case where the engine 2 is mounted on a vehicle body of a power chemical applicator. If the undesirable resistance during the upward movement of the piston is not increased by providing the oil-mist breather in fluid communication with the fuel tank 14, the orifice 28 may also be omitted.

In the above embodiment, the check valve 26 and the orifice 28 are disposed in the vicinity of the fuel tank 14 along the longitudinal direction of the breather passage P of the oil-mist breather 22. While this arrangement advantageously provides increased volume of the oil-mist containing air to be compressed, the check valve 26 and the orifice 28 may be disposed at any other suitable position of the breather passage P. Further, as long as the check valve 26 is disposed downstream of the orifice 28, it is not essential to dispose the check valve 26 and the orifice 28 adjacent to one another.

The structure of the check valve 26 is not limited to the type in which the valve member 26*a* is moved by force of positive and negative pressures in the crank chamber 8, and any other suitable structure may be applied to the check valve 26. For example, a coil spring may be provided to bias the valve member 26*a* toward the downstream outlet of the orifice 28, and the valve member 26*a* may be opened by force of the positive pressure in the crank chamber 8.

While the four-stroke cycle internal combustion engine 2 according to the above embodiment includes the coil spring 34 for atomizing the lubricating oil in the oil reservoir chamber 12, the device for atomizing the lubricating oil is not limited to such a structure. For example, an oil dipper may be provided in the connecting rod 13 to splatter the lubrication oil.

Further, while the four-stroke cycle internal combustion engine 2 according to the above embodiment is an OHC type four-stroke cycle internal combustion engine, it can be an OHV type four-stroke cycle internal combustion engine.

As described above, the present invention can provide a four-stroke cycle internal combustion engine having an oil-mist breather which is free from the defect causing contamination of an air filter.

What is claimed is:

1. A four-stroke cycle internal combustion engine in which lubrication oil is atomized to generate oil mist so as to lubricate an internal mechanism of said engine with said oil mist, said four-stroke cycle internal combustion engine comprising:

an oil-mist breather in fluid communication with a fuel tank of said engine, wherein any oil mist remaining after the lubrication of said internal mechanism is discharged into said fuel tank through said oil-mist breather.

2. A four-stroke cycle internal combustion engine in which oil mist is generated in the vicinity of a crank chamber and the generated oil mist is fed from said crank chamber to a valve chamber through an oil-mist passage so as to lubricate the respective insides of said crank camber and said valve chamber, said four-stroke cycle internal combustion engine comprising:

an oil-mist breather including a breather passage for providing fluid communication between said valve chamber and a fuel tank of said engine, wherein any oil mist remaining in said valve chamber is discharged into said fuel tank through said oil-mist breather.

3. A four-stroke cycle internal combustion engine as defined in claim 1, wherein said oil-mist breather includes a check valve disposed in said breather passage and an orifice disposed in said breather passage upstream of said check valve, said check valve being operable to close said breather passage when a fuel in said fuel tank flows into said breather passage and when a piston of said engine moves upward.

4. A four-stroke cycle internal combustion engine as defined in claim 2, wherein said oil-mist breather includes a check valve disposed in said breather passage and an orifice disposed in said breather passage upstream of said check valve, said check valve being operable to close said breather passage when a fuel in said fuel tank flows into said breather passage and when a piston of said engine moves upward.

5. A four-stroke cycle internal combustion engine as defined in claim 3, wherein said orifice and said check valve are disposed in the vicinity of said fuel tank along a longitudinal direction of said breather passage.

6. A four-stroke cycle internal combustion engine as defined in claim 4, wherein said orifice and said check valve are disposed in the vicinity of said fuel tank along a longitudinal direction of said breather passage.

7. A four-stroke cycle internal combustion engine as defined in claim 3, wherein said check valve is disposed between said fuel tank and said orifice, said check valve including a valve member for closing an outlet of said orifice at the side of said fuel tank.

8. A four-stroke cycle internal combustion engine as defined in claim 4, wherein said check valve is disposed between said fuel tank and said orifice, said check valve including a valve member for closing an outlet of said orifice at the side of said fuel tank.

9. A four-stroke cycle internal combustion engine as defined in claim 5, wherein said check valve is disposed between said fuel tank and said orifice, said check valve including a valve member for closing an outlet of said orifice at the side of said fuel tank.

10. A four-stroke cycle internal combustion engine as defined in claim 6, wherein said check valve is disposed between said fuel tank and said orifice, said check valve including a valve member for closing an outlet of said orifice at the side of said fuel tank.

* * * * *